United States Patent [19]

Newcomb et al.

[11] 4,128,238

[45] Dec. 5, 1978

[54] PRACTICE BASEBALL

[76] Inventors: Nelson F. Newcomb; Nelson F. Newcomb, Jr., both of P.O. Box Mirror Lake, Mirror Lake, N.H. 03853

[21] Appl. No.: 737,841

[22] Filed: Nov. 1, 1976

[51] Int. Cl.[2] ..... A63B 37/14; A63B 43/04

[52] U.S. Cl. ..... 273/26 R; 273/60 B; 273/58 K; 273/DIG. 20

[58] Field of Search ..... 273/60 R, 60 A, 60 B, 273/26 R, 26 D, 89, 28, 58 K

[56] References Cited

U.S. PATENT DOCUMENTS

| | | | |
|---|---|---|---|
| 2,694,574 | 11/1954 | Baker | 273/58 K |
| 3,009,452 | 11/1961 | Barber et al. | 273/89 X |
| 3,099,450 | 7/1963 | Randall | 273/26 R X |
| 3,152,803 | 10/1964 | Sain | 273/26 R |
| 3,865,378 | 2/1975 | McPhail et al. | 273/58 K X |

*Primary Examiner*—George J. Marlo
*Attorney, Agent, or Firm*—C. Yardley Chittick

[57] ABSTRACT

A baseball made to meet playing rule requirements as to size and weight but having a small segment removed therefrom so that the ball when thrown by a pitcher without any twist being imparted to the ball will curve in the same manner and degree as a conventional baseball when thrown by a competent curve ball pitcher.

3 Claims, 11 Drawing Figures

FIG. 1.
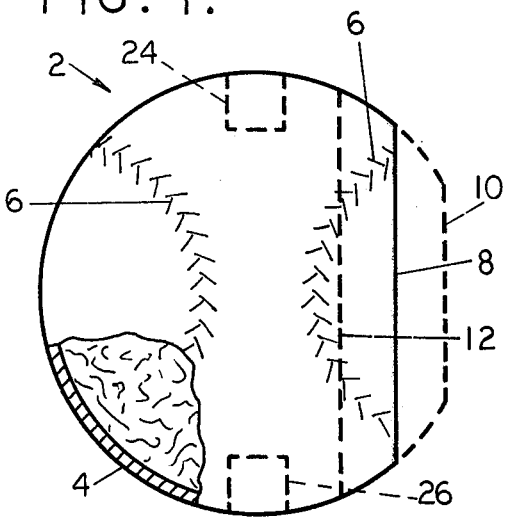
FIG. 2.
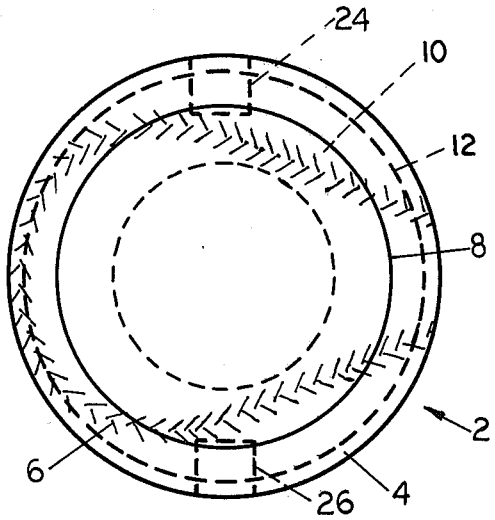
FIG. 3. FIG. 4. FIG. 5. FIG. 6. FIG. 7. FIG. 8.
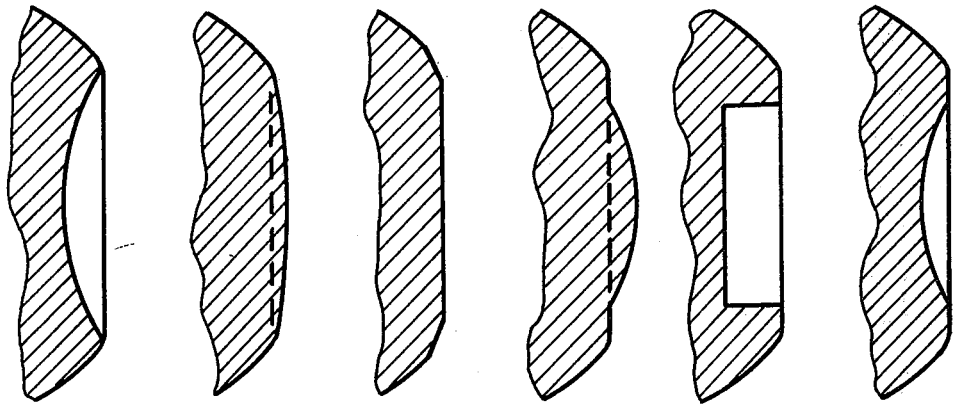
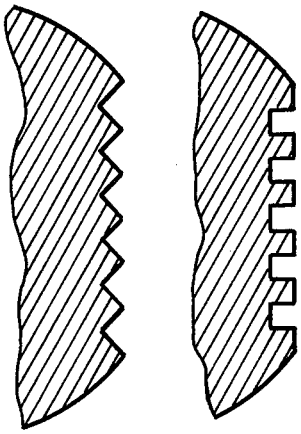
FIG. 9. FIG. 10.
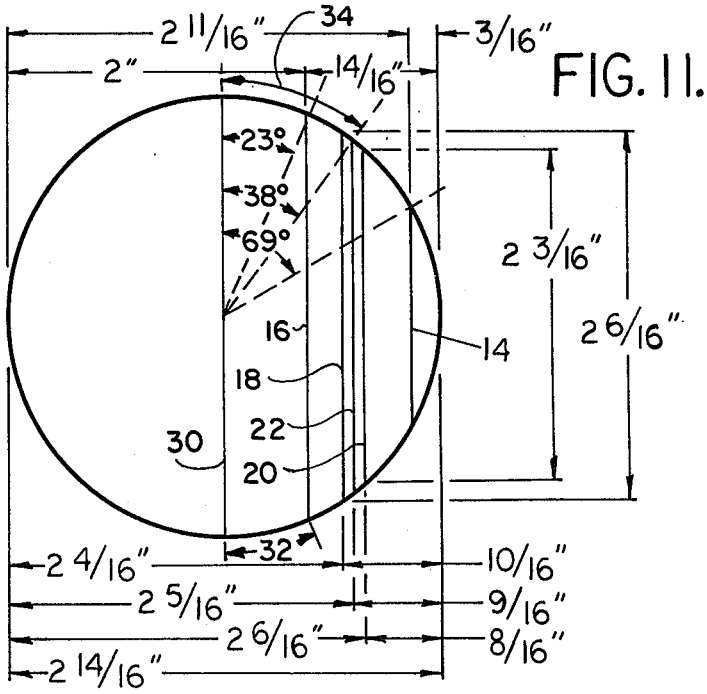
FIG. 11.

PRACTICE BASEBALL

BACKGROUND OF THE INVENTION

In playing the game of baseball, a competent player must be able to field well and be a good batter against first class pitching. A first class pitcher can throw straight balls of varying speeds and curve balls which curve or "break" to a greater or less degree depending upon the speed and twist imparted to the ball.

In throwing straight balls, the stress on the pitcher's arm is far less than that imposed when throwing a curve. The curve requires, in addition to the usual throwing motion of the arm, a rapid twisting movement of the hand, wrist, forearm, and elbow just before release of the ball.

Repeated throwing of curves puts so much stress on the pitcher's wrist and elbow that a "sore arm" is very likely to develop. Under game conditions, a pitcher will mix up his curves and straight balls to make it as difficult as possible for the batter to hit the ball. Under practice conditions, however, coaches at all levels (little leagues through major leagues) are reluctant to call on their pitchers to throw many curves to practicing batsmen lest the pitchers be incapacitated by the development of "sore arms".

Therefore, the batter's opportunities to practice hitting curve balls are limited with the result that under game conditions, a good curve ball pitcher usually has the upper hand over the batters.

Attempts have been made to provide mechanical ball throwers capable of throwing curves. These machines, however, are beyond the financial reach of most schools and colleges where most baseball players receive their initial instruction and playing opportunities. Accordingly, the inability to practice at length against curve ball pitching has proved to be a great disadvantage in the development of competent batsmen who in the professional field must be able to hit all kinds of pitches.

A further disadvantage of the mechanical ball thrower is that it does not present to the batter the image of a pitcher winding up and throwing what the batter sees under game conditions.

There is, therefore, a great need for a practice baseball which can be made to curve by an ordinary pitcher without placing any more stress on the pitching arm than that required to throw a straight ball.

We are aware that projectiles or other devices intended to curve when thrown are disclosed in the prior art. However, we are unaware of any full sized and correctly weighted baseball having characteristics which enables it to curve when thrown by a pitcher using the easiest possible pitching motion.

SUMMARY OF THE INVENTION

The object of our invention is to provide a baseball of standard size and weight which when thrown in the manner of throwing a straight ball either overhand, three quarters, or side arm, will curve the same as a curve pitch thrown by a major league professional pitcher.

This result is achieved by removing a relatively small segment from the baseball. The removal of the segment leaves a small flat area on the side of the ball. The ball is gripped in the usual manner for throwing a straight ball with the flat area to the right of the middle finger. The ball when released will rotate about the axis that extends perpendicular to the flat area. As the ball approaches the catcher, it will curve in the direction away from the flat area. That is, the ball when thrown by a right-handed pitcher will curve away from a right-handed batter.

If the flat area is positioned between the thumb and forefinger of a right-handed pitcher, the ball will curve in toward a right-handed batter or away from a left-handed batter.

If the pitch is thrown side arm, with the flat area more or less horizontal and facing skyward, the ball will "break" sharply downward in the manner of the so-called "drop". When the flat area is facing the ground, the ball will tend to rise, offsetting gravity.

A pitcher using our practice baseball with the easy straight ball throwing motion will, with only limited practice, be able to cause the ball to follow a curved path to the catcher which will correspond to all of the curve pitcher that can be thrown by major league professional pitchers. Thus we have provided a means whereby curve balls may be repeatedly thrown by a pticher to a batter in batting practice with the pitcher using only the easy motion of straight ball pitching.

The opportunity to practice against curving pitches is very important to a batter. Our practice baseball makes this possible because anyone capable of throwing only a straight ball can produce the required curves for batting practice.

It should further be noted that our baseball in one form is made of the same materials and in substantially the same manner as the conventional official baseball used in the major leagues and, therefore, may be hit by the batter with the same feel and results as obtained with the official ball. The body of our baseball may also be made of any other suitable materials having rubber or synthetic materials for the cover. In some cases the cover may be omitted.

When the ball is thrown with its axis of rotation not passing through the flat area, the aerodynamic forces are more or less balanced so that the ball follows substantially a straight path. Thus the pitcher still using the easy straight pitch motion can mix up his pitches so that the practicing batter sees all kinds of pitches just as he would in a game.

It is known fact that when a good big league fast ball pitcher throws a fast ball, the speed of the ball through the air produces a swishing sound which the batter hears prior to the arrival of the ball. This sound has a very unnerving effect on an inexperienced batsman. In order to produce a similar sound so that the practicing batsman may become accustomed to it, we have found that by introducing a plurality of sizeable holes of limited depth into the surface of our practice baseball and located on the great circle that is at right angles to the axis of the flat area about which the curving ball spins, a very similar swishing sound is produced.

It will be understood, however, that the sound-producing holes are completely independent of the curve-producing ability of the flat area. The holes simply add an extra capability to our practice baseball.

The invention also contemplates that in a preferred form the average density of the material of which our ball is made will be greater than the average density of a conventional baseball to compensate for the smaller volume of our baseball occasioned by the removal of the segment.

The practice baseball may have a conventional stitched cover with the usual raised seams. In another form the cover may be molded with simulated stitching. It will also be appreciated that the ball may be made in different sizes and weights to conform with the rule requirement of different leagues such as the major leagues, the softball leagues, and the "Little Leagues".

BRIEF DESCRIPTION OF THE DRAWINGS

FIG. 1 is a side elevation of our practice baseball showing the flat area created by the removal of a small segment. The ball is broken away in part to indicate a cover.

FIG. 2 is a view of FIG. 1 looking at the ball from the right.

FIG. 3 shows a concave surface area instead of the flat area of FIG. 1.

FIG. 4 shows a convex surface area.

FIG. 5 shows a flat area with the peripheral edge thereof beveled to meet the spherical surface.

FIG. 6 is a further modification in which there is a flat annular area surrounding a convex area.

FIG. 7 is another modification in which the flat area is recessed.

FIG. 8 is a modification having a flat annular area surrounding a concave area.

FIG. 9 shows a generally flat area across which extends a plurality of V-shaped parallel grooves.

FIG. 10, like FIG. 9, shows a generally flat area with a different type of groove.

FIG. 11 is a drawing to scale giving the dimensions of the limiting maximum and minimum removed segments falling within the scope of the invention and the dimensions of the preferred construction.

DESCRIPTION OF A PREFERRED EMBODIMENT

Before proceeding with the detailed description of our practice ball, it should be understood that when the term "flat area" is used in the specification and claims, it is intended to include all surface area configurations that define that part of the surface of the ball that is non-spherical. Some of the various alternatives are shown in FIGS. 3 to 10.

While the literally flat area shown in FIGS. 1 and 2 has been proved by experimentation to produce proper curving of the thrown ball, nevertheless it is also known that slightly different results may be obtained with differently formed non-spherical areas all of which are encompassed within the term "flat area" used for convenience herein.

Referring now to FIGS. 1 and 2, there is shown a conventional baseball at 2 having a cover 4 made of the usual two pieces of leather stitched together as at 6.

A segment of the sphere has been removed to leave a flat area 8. The cover may be so designed that the stitching may or may not cross the flat area 8. The volume of the segment removed may be varied within limits to produce a flat area of less or greater diameter as suggested by the dotted lines 10 and 12.

We have found that the smaller the flat area the less the ball will curve. On the other hand, the flat area cannot be too large lest it interfere with the normal grip of the hand on the ball and also cause the ball to curve excessively.

When reference is made hereinafter to the "normal grip" or "normal gripping position" of the hand on the baseball, it will be understood by those familiar with the manner in which a baseball is customarily held to be thrown as a straight ball to mean that the baseball is held principally between the forefinger and middle finger on one side of the ball and the thumb on the other side. Considered in relation to a great circle about our practice baseball, the plane of which parallels the flat area which in this discussion is to the right of the great circle, the middle finger of a right-handed pitcher will be between the great circle and the periphery of the flat area, the forefinger will be on the other side of the great circle adjacent the middle finger and the thumb will be on the opposite side of the ball more or less on the great circle. The end of the thumb will be at a distance of more than 180° along the great circle from the tips of the forefinger and middle finger. The side of the ring finger normally will rest against the flat area. The little finger does not engage the ball in the normal gripping position for throwing a straight ball. When the flat area is to the left of the great circle so that the ball thrown by a right-handed pitcher will curve to the right, then the pitcher's forefinger is between the great circle and the periphery of the flat area, the middle finger is to the right of the great circle and the thumb is more or less on the great circle opposite the fore and middle fingers.

When a left-handed pitcher throws our practice baseball, it will be understood that the finger locations are reversed.

The diameter of an official major league baseball as defined by the rules must be between 2.86 inches and 2.94 inches. The weight must be between 5 ounces and 5¼ ounces.

In the following discussion aided by reference to FIG. 11 we will consider a baseball 2 14/16" in diameter. This dimension lies between the stated limits of 2.86 and 2.94 inches and, therefore, represents a legal sized ball. We have found that in order for the ball to curve to a minimum required degree, a segment having a height of at least 3/16" must be removed. The flat area of this minimum segment is indicated at 14 in FIG. 11. The volume of this segment will be about 1% of the volume of the baseball.

On the other hand, as the removed segment is increased in size, the ball will curve to a greater extent. The limiting size of the segment is indicated at 16 in FIG. 11. The volume of this segment will be about 21% of the volume of the baseball.

For best all around results we have determined that the removed segment should have a height of preferably not less than 8/16" and not more than 10/16". Segments of these sizes will produce flat areas with diameters from about 2 3/16" to about 2 6/16". The volume of the removed segment of preferred size will be about 10% of the volume of the baseball.

The ball diameter taken perpendicular to the flat area and referred to as the minor diameter will in our preferred form vary from 2 4/16" to 2 6/16" as indicated by the lines 18 and 20.

In order to be more precise in explanation of the construction of our ball, further reference is made to FIG. 11. The line 30 represents a great circle the plane of which is parallel to all of the illustrated flat areas 14, 16, 18, 20 and 22. The angle taken from the center of the ball between the great circle and the periphery of flat area 16 is approximately 23°. The annular surface area between the great circle 30 and the periphery of flat area 16 designated 32 represents the minimum area that will remain on the right of the great circle 30 after removal of the maximum sized segment that falls within the scope of our invention. The circular distance 32 is wide enough to receive in proper gripping position, the middle finger of a right-handed pitcher's hand or the forefinger of a left-handed pitcher's hand.

The angle from the ball center between the great circle 30 and the periphery of the preferred flat area 22 is approximately 38°. Here the circular distance 34 of the annular surface to the right of great circle 30 is large enough to provide more selective positioning of the right-handed pitcher's middle finger or the left-handed pitcher's forefinger. The included angle between the great circle 30 and the periphery of the minimum flat area 14 is approximately 69°.

Thus in further definition of the invention the included angle between the great circle that parallels the flat areas and the peripheries of the maximum and minimum flat areas is not less than 23° nor more than 69° with the preferred angle being 38°.

By further appropriate calculations, it will be found that the area of the spherical portion of the baseball to the juncture of the flat area 16 will be about 70% of the total area of the undiminished sphere; the area of the spherical portion of the baseball to the juncture of the flat area 14 will be about 93% of the undiminished sphere; and the area of the spherical portion of the ball to the preferred juncture 22 of the flat area will be about 80% of the total area of the undiminished sphere.

The invention thus comtemplates a spherical area to the juncture of the flat area that will be between 70% and 93% of the total spherical area of a complete spherical baseball of the same diameter. The above recited percentage area figures are applicable to all practice baseballs regardless of their diameters and weights. They include specifically practice baseballs made according to major league, soft ball league and the smaller little league specifications.

From the foregoing discussion, it is to be understood that our practice baseball invention contemplates a range of flat areas running from a minimum minor diameter to the flat area 16 of 2" to a maximum minor diameter to the flat area 14 of 2 11/16" and with a preferred minor diameter to the flat area 22 of 2 5/16". In all cases however the annular area between the periphery of the flat area and the great circle that lies in a plane parallel to the flat area is wide enough to accept thereon the middle or forefinger of the pitcher's hand.

Obviously, the practice baseball can be manufactured to provide any sized flat area within the limits 14 and 16 of FIG. 11 deemed most appropriate by the user. In general, however, the practicing batter will find that the curves produced by our practice baseball having a major diameter of between 2.86 and 2.94 inches and a minor diameter to the flat area of between 2 4/16 and 2 6/16 inches will approximate the curves he will see in competition when the baseball is thrown by a competent curve ball pitcher.

The configuration of the flat area may be modified in a wide variety of forms. Some are suggested in the fragmentary cross sectional views in FIGS. 3 to 10. These flat areas will change the curving characteristics somewhat but not to the extent that would take a baseball so made outside the scope of this disclosure. In all modified forms of the flat area, the ball will curve when thrown if the ball is caused to rotate about the axis perpendicular to the flat area.

If the pitcher wishes to throw our practice ball straight, he merely causes the ball to rotate about an axis at right angles to the flat area axis.

The cavities 24 and 26 shown in dotted lines in FIGS. 1 and 2 will cause a swishing sound simulating the sound of the ball when thrown by a fast ball pitcher.

The practice baseball may be made in conventional manner of rubber, cork, yarn, or any other material that would produce a ball of correct weight and proper batting characteristics .

Turning now to the question of weight. The major league ball must weight between 5 and 5¼ ounces. The removal of the segment to produce the flat area will obviously reduce the weight of our ball below the five ounce limit if the ball is made of materials having the same density as the materials used in an official major league baseball.

Since it is important to the pitcher throwing our practice baseball that the weight be the same as that of the official ball, our ball in the preferred construction is made of materials having an average density greater than that of the materials in the official baseball.

In further explanation of the weight question, removal of the segment along the line 22 in FIG. 11 will reduce the volume and weight of the original sphere by about 10%. The ball would then be on the light side weighing between 4½ to 4¾ ounces. Therefore, in the preferred manufacturing procedure of our ball, the materials should have an average density at least 11% greater than the materials of an official ball. Our ball then, although of 10% less volume, will have a proper weight of between 5 and 5¼ ounces. Since the surface of our ball being gripped by the pitcher's thumb and fore and middle fingers will be the same size as the official ball and the weight of the ball will be within the required limits of 5 to 5¼ ounces, the pitcher will perceive no throwing difference between our ball and a conventional ball. The result is that his throwing motion will be unchanged when our practice ball is used.

While the foregoing description is directed to the official major league baseball, it will be understood that the principles involved are equally applicable to larger sized baseballs such as the so-called softball which has a major diameter of 3 6/8 to 3 7/8 inches and a weight of 6 to 6¾ ounces.

The principles of the invention are also applicable to balls smaller and lighter than the official major league ball. The limiting minimum dimensions as to diameter and weight are reached when the practice baseball does not have an annular space between the great circle and the juncture of the flat area large enough to receive the thrower's gripping fingers and/or when the ball thrown in the manner of a straight ball will not curve in the controlled manner heretofore described. To produce a satisfactory curve with the softball, a segment in the order of 10% of the volume of the softball should be removed. The invention, however, as previously explained has a range of removed segment size between 1% and 21% of the total volume of the baseball in question.

It is intended to cover all changes and modifications of the example of the invention herein chosen for purposes of the disclosure which do not constitute departures from the spirit and scope of the invention.

We claim:

1. A practice baseball adapted to be thrown by baseball pitchers and so constructed that when thrown in the manner that a straight ball is thrown by baseball pitchers, it will curve to a controllable degree, said baseball having the following characteristics, a. it has two distinct outer surfaces one of which comprises the major spherical portion of the surface of a sphere and the other surface has a shape other than that of said major spherical portion, b. the area of said major spherical portion is between 70% and 93% of the area of a complete sphere of the same diameter, c. the annular part of the major spherical portion lying between (1) the juncture of said major spherical portion and said other surface and (2) a great circle parallel to said juncture is large enough to accept at least one finger of the thrower's hand when the ball is held in the ball gripping position required for throwing a conventional baseball as a straight ball, and d. the weight of the said practice baseball being the same as the weight of a conventional fully spherical baseball used in league play and the diameter of said major spherical portion of said practice baseball corresponds to the diameter of said conventional fully spherical baseball used in league play.

2. A practice baseball adapted to be thrown by baseball pitchers and so constructed that when thrown in the manner that a straight ball is thrown by baseball pitchers, it will curve to a controllable degree, said baseball having the following characteristics, a. it has two distinct outer surfaces one of which comprises the major spherical portion of the surface of a sphere and the other surface has a shape other than that of said major spherical portion, b. the area of said major spherical portion is between 70% and 93% of the area of a complete sphere of the same diameter, c. the annular part of the major spherical portion lying between (1) the juncture of said major spherical portion and said other surface and (2) a great circle parallel to said juncture is large enough to accept at least one finger of the thrower's hand when the ball is held in the ball gripping position required for throwing a conventional baseball as a straight ball, and d. the weight of said practice baseball being between 5 and $5\frac{1}{4}$ ounces and the major diameter being between 2.86 and 2.94 inches.

3. A practice baseball adapted to be thrown by baseball pitchers and so constructed that when thrown in the manner that a straight ball is thrown by baseball pitchers, it will curve to a controllable degree, said baseball having the following characteristics, a. it has two distinct outer surfaces one of which comprises the major spherical portion of the surface of a sphere and the other surface has a shape other than that of said major spherical portion, b. the area of said major spherical portion is between 70% and 93% of the area of a complete sphere of the same diameter, c. the annular part of the major spherical portion lying between (1) the juncture of said major spherical portion and said other surface and (2) a great circle parallel to said juncture is large enough to accept at least one finger of the thrower's hand when the ball is held in the ball gripping position required for throwing a conventional baseball as a straight ball, and d. the weight of said practice baseball being between 6 and $6\frac{3}{4}$ ounces and the major diameter being between $3\frac{3}{4}$ and $3\frac{7}{8}$ inches.

* * * * *